US005243832A

United States Patent [19]

Van Steenburgh, Jr.

[11] Patent Number: 5,243,832

[45] Date of Patent: * Sep. 14, 1993

[54] REFRIGERANT RECLAIM METHOD AND APPARATUS

[76] Inventor: Leon R. Van Steenburgh, Jr., 1900 S. Quince St., Unit G, Denver, Colo. 80231

[ * ] Notice: The portion of the term of this patent subsequent to Dec. 17, 2008 has been disclaimed.

[21] Appl. No.: 744,588

[22] Filed: Aug. 12, 1991

Related U.S. Application Data

[60] Continuation of Ser. No. 569,229, Aug. 17, 1990, Pat. No. 5,072,593, which is a continuation of Ser. No. 294,823, Jan. 9, 1989, abandoned, which is a division of Ser. No. 109,958, Oct. 19, 1987, abandoned.

[51] Int. Cl.[5] ..... F25B 45/00

[52] U.S. Cl. ..... 62/292; 62/149

[58] Field of Search ..... 62/292, 77, 149, 473, 62/470, 84

[56] References Cited

U.S. PATENT DOCUMENTS 3,850,009 11/1974 Villladsen ..... 62/473
4,646,527 3/1987 Taylor ..... 62/292 X
4,939,905 7/1990 Manz ..... 62/292 X

*Primary Examiner*—Henry A. Bennet
*Attorney, Agent, or Firm*—Beaton & Swanson

[57] ABSTRACT

A refrigerant reclaim system includes a compressor, a heat exchanger, an oil separator, a condenser, a chill tank, a filter-dryer and a cooling coil in the chill tank. Refrigerant to be reclaimed is drawn through the cold side of the heat exchanger, converted to a gas which is discharged into the oil separator where the gas is directed upwardly in an expanding stream. The flow of the stream is abruptly interrupted to separate oil from refrigerant. The gaseous refrigerant is passed from the oil separator through the compressor, the hot side of the heat exchanger, a condenser and into the chill tank in a liquid state. Liquid refrigerant flows from the bottom of the chill tank through a filter-dryer, an expansion device, converting it to gas, through a cooling coil, submerged in liquid refrigerant in the chill tank, into the stream exiting the oil separator and back to the compressor. Controls are provided for shutting down the cold side of the heat exchanger and the oil separator while the chill tank, filter-dryer, cooling coil, compressor and condenser continue to be active.

7 Claims, 1 Drawing Sheet

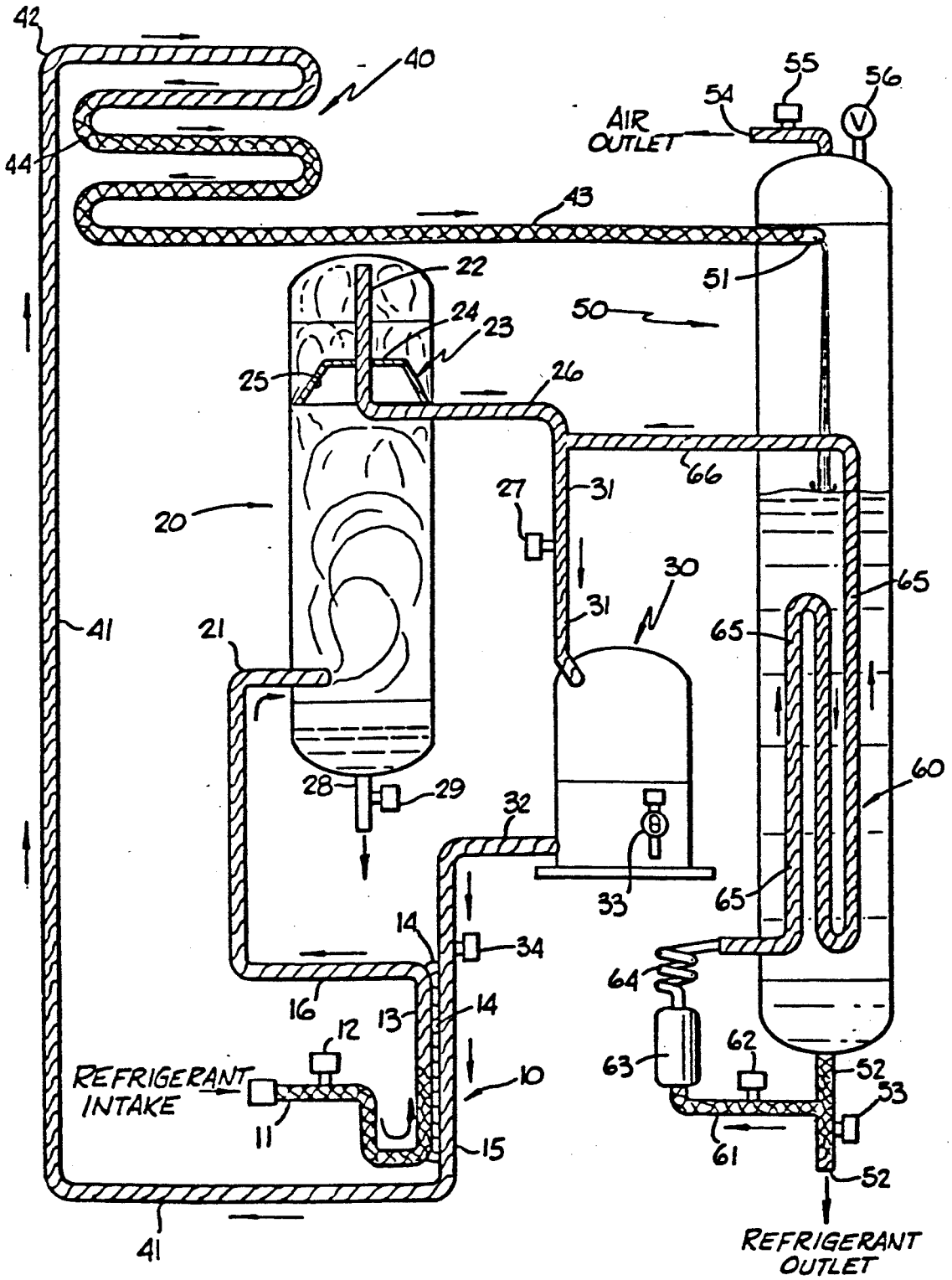
42
40
44
43
AIR OUTLET
54
55
56
V
51
22
24
23
50
25
26
66
20
27
31
30
65
41
21
31
65
60
28
29
32
33
65
14
34
64
16
13
14
12
63
62
52
REFRIGERANT INTAKE
11
10
53
15
61
52
41
REFRIGERANT OUTLET

REFRIGERANT RECLAIM METHOD AND APPARATUS

This is a continuation of copending application Ser. No. 07/569,229 filed on Aug. 17, 1990, now U.S. Pat. No. 5,072,593, which is a continuation of 07/294,823 filed on Jan. 9, 1989, now abandoned, which is a division of 07/109,958, filed on Oct. 19, 1987, now abandoned.

This invention relates to a method and apparatus for removing refrigerant from a refrigeration system during repairs, confining it so as to avoid its escape to the atmosphere, separating contaminants from the refrigerant and returning the refrigerant to the repaired refrigeration system or discharging it to a storage container. The invention is particularly adapted for incorporation in a mobile unit of the general type illustrated in U.S. Pat. Nos. 3,232,070 and 4,476,688.

BACKGROUND OF THE INVENTION

A number of years ago when the refrigeration system in an air conditioner, for example, required repairs or when the refrigerant, such as those sold under the trademark "Freon", was contaminated sufficiently to affect the effectiveness of refrigeration, it was the standard practice to bleed the refrigerant to the atmosphere. This practice was not only costly, but environmentally unsound.

In more recent times it has been the practice to remove the refrigerant with means which confines it while separating contaminants, liquefies it and either returns it to the refrigeration system or stores it. Two such reclaim systems are illustrated in U.S. Pat. Nos. 4,476,688 and 4,646,527. Each includes a compressor, the intake side of which draws the refrigerant from the refrigeration system through contaminant removal means into the compressor and discharges the refrigerant into a condenser which liquefies it and discharges it into storage means from which it may be returned to the refrigeration system, if desired.

Prior art systems of this type have generally not provided truly adequate means for making certain that refrigerant entering the compressor is in a gaseous state, which is necessary to avoid damaging the compressor. Nor do the prior art systems provide means for cooling and controlling the temperature of the liquid refrigerant while it is held or stored in the reclaim system so that the appropriate amount of refrigerant can easily be transferred back to the refrigerator system. Often at the time the refrigeration system of a repaired air conditioner is to be recharged with refrigerant, the gases still within the system are at an elevated temperature resulting in the pressure being high enough that liquid refrigerant at room temperature cannot enter, or can only slowly enter, the system by gravity flow. When refrigerant in the reclaim system has been cooled to a temperature well below the temperature of gases within a container to be charged, the cooler refrigerant will flow partially into the warmer gas, cooling it in the process and thus reducing the pressure of the gas and the resistance to flow of the refrigerant.

It is known in the prior art to provide means for repeatedly recycling the refrigerant through a standard filter-dryer unit during the repair operations, to ensure maximum removal of the acid and water vapor, one such recycling loop being shown in U.S. Pat. No. 4,476,688. Without means to cool the recycling refrigerant, however, its temperature will inevitably rise and this will reduce the efficiency of standard filter-dryers and make it much more difficult to discharge the refrigerant directly from the reclaim system back into the repaired refrigeration system.

SUMMARY OF THE INVENTION

The present invention provides a method and means for drawing refrigerant from a container, or a refrigeration system to be repaired, heating the refrigerant sufficiently to maintain it in a gaseous state while it passes through an oil separator into the intake of a compressor. Compressed gaseous refrigerant is discharged from the compressor and passed through a heat exchanger to heat the incoming liquid refrigerant and then passes through a condenser where it is liquefied. The liquefied refrigerant is passed from the condenser into a hold tank from the bottom of which liquid refrigerant flows through a filter-dryer and an expansion device for reconverting the liquid refrigerant to gaseous form. From the expansion device the gaseous refrigerant passes through a coil submerged in the liquid in the hold tank and then is passed back to the intake of the compressor. The temperature of the liquid in the hold tank is lowered by the chilling effect of the expanding gaseous refrigerant passing through the coil submerged in the liquid and because of this chilling effect the hold tank is referred to as a "chill tank." The refrigerant can be repeatedly passed from the chill tank through the filter-dryer, expansion device, cooling coil, compressor, heat exchanger, condenser and back to the chill tank so as not only progressively to lower its temperature in the chill tank but also repeatedly, and thus more completely, to remove acid and water from it.

The invention can be more fully understood when the detailed description which follows is read with reference to the accompanying drawing.

THE DRAWING

The drawing is a schematic illustration of the invention in which the parts illustrated are either standard items which can be purchased or are disclosed in sufficient detail when viewed in conjunction with the description so as to teach those skilled in this art how to practice this invention.

THE DETAILED DESCRIPTION

As illustrated in the drawing, the reclaim system of this invention includes a heat exchanger 10, one portion of which is in fluid communication with a refrigerant intake fluid conduit 11 controlled by solenoid valve 12. The conduit 11 is in fluid communication with conduit 13 which constitutes the cold side of heat exchanger 10. The conduit 13 is illustrated as being joined to conduit 15 by thermally conductive weld 14. Conduit 15 constitutes the hot side of heat exchanger 10. The heat exchanger arrangement shown in the drawing is for illustration purposes only. In practice it is preferred that intake 11 be in fluid communication with a conduit with a spiral fin, or ridge and groove arrangement, facilitating its being mounted within a conduit to form a so-called tube-within-a-tube heat exchanger. Preferably also the tube-within-a-tube construction is in the form of a coil so as to provide greater length in a smaller space than would be possible with a straight tube-within-a-tube construction. The coiled tube-within-a-tube is a standard item well known in the heat exchange art, and it will be apparent that the inner tube should be the cold side and the outer tube the hot side of the heat exchanger.

Conduit 16 constitutes the outlet from the cold side of heat exchanger 10 and is in fluid communication with oil separator 20 through the conduit 21. The oil separator 20 is preferably an elongated pressure cylinder with partially spherical ends mounted so that its longitudinal axis extends vertically. The fluid conduit 21 extends through the outer wall of the oil separator tank 20 somewhat above the lower end of the tank and extends inwardly so that its open end is near the axis of the tank. Another fluid conduit 22 has its open end fixed near the inner surface of the rounded top of the tank. The fluid conduit extends downwardly and supports a circular baffle 23 composed of a disc-like portion 24 and a downwardly extending partially cone-shaped skirt 25. Conduit 22 is arranged to extend along the axis of the tank and is connected to fluid conduits 26 and 31 controlled by a low pressure activated electrical control device 27 having a pressure gauge indicator associated with it. The control 27 will automatically shut down compressor 30 when the pressure in conduit 31 drops to virtually zero PSIG. Oil from the bottom of oil separator 20 can be discharged through fluid conduit 28 controlled by solenoid valve 29.

Fluid conduit 31 extends through the outer wall of compressor 30 and a short distance into its interior as illustrated. Compressor 30 is provided with a fluid conduit outlet 32 and an oil sight gauge and oil supply device 33. Outlet conduit 32 has a high pressure activated electrical control device 34 associated with it and is in fluid communication with conduit 15 of heat exchanger 10 and is thus in fluid communication with conduit 41, which in turn is in fluid communication with a condenser 40 through condenser inlet conduit 42. If pressure in conduit 32 is too high, control 34 acts automatically to shut down compressor 30.

Outlet conduit 43 connects condenser 40 in fluid communication with chill tank 50, which as illustrated is an elongated, cylindrical pressure tank arranged with its longitudinal axis extending vertically and having upper and lower ends of partially spherical shape. Outlet end 51 of fluid conduit 43 is located substantially on the axis of chill tank 50. At the bottom of the chill tank 50 there is a fluid conduit 52 controlled by solenoid valve 53 and arranged in fluid communication with the interior of chill tank 50. At the upper end of chill tank 50 there is an air outlet conduit 54 controlled by solenoid valve 55 having a pressure gauge indicator associated with it. Conduit 54 is vented to the atmosphere through a small orifice to prevent an explosive discharge of air. Fluid conduits 52 and 54 open into the interior of chill tank 50 at points preferably on the longitudinal axis of the tank. Also located at the upper end of chill tank 50 is a high pressure activated safety valve 56.

Located partially within and partially outside chill tank 50 is a cooling and recycling system 60 composed of a conduit 61 in fluid communication with conduit 52 and controlled by solenoid valve 62. The fluid conduit 61 is in fluid communication with filter-dryer 63, which in turn is connected in fluid communication with an expansion device 64, illustrated in the drawing as being a capillary tube. The expansion device 64 is in fluid communication with conduit 65 arranged in the form of a coil within chill tank 50. The cooling coil 65 is in fluid communication with conduit 66, which in turn is in fluid communication with inlet conduit 31 of compressor 30.

All the elements of the reclaim system of this invention can be mounted within a mobile cabinet (not shown) having a control panel in one outer surface and casters underneath it.

The control panel includes a power on-off switch which, depending on the positions of various valves and the pressures at various points in the system, energizes the compressor 30 and the valves 12, 29, 55, 53 and 62. Since controls 27 and 34 shut down or start up compressor 30 automatically when power is on, and since relief valve 56 responds automatically to pressure, the control panel need not include switches for manually activating these devices. Hence the control panel need include only, in addition to the power on-off switch, switches for valve 12 (refrigerant in), valve 29 (oil out), valve 53 (refrigerant out), valve 55 (air out) and valve 62 (control for cooling and recycling system 60), or a total of six switches. The control panel also includes two pressure gauge indicators, one for displaying the pressure entering conduit 31 and the other for displaying the pressure at valve 55 and the upper portion of chill tank 50. Details of the circuitry for electrically connecting switches, controls, valves and gauges will be apparent to those skilled in this art.

Chill tank 50, being the largest element of the reclaim system, and being about 48 inches in height, the cabinet should be about 62 inches in height including the height of the casters. The cabinet can be about 28 inches in width and 24 inches in depth if the cabinet contains the system illustrated in the drawing which has only one chill tank 50. As will be apparent to those skilled in the art, if the cooling effect from one chill tank 50 is insufficient, one or more additional chill tanks can be provided and connected to run in parallel with the first chill tank 50. Each chill tank is preferably about 6 inches in diameter, has a capacity to store or hold 45 lbs. of refrigerant such as "Freon" 12, 22 or 502 and meets ASME and Underwriters Laboratory specifications for pressure tanks. The tank for oil separator 20 preferably meets the same specifications and is 36 inches long and 6 inches in diameter. Compressor 30 is of a type in which a combination sight gauge and oil inlet cap 33 can be provided for maintaining proper lubrication in compressor 30. The following is a compilation of the items which are standard devices which can be purchased, together with an identification of these items:

| Item Description | Manufacturer | Identification No. |
|---|---|---|
| Compressor 30 | Copeland Corp. | SSC4-0200 |
| Condenser 40 | Snow Coil Co. | 5858M786 |
| Heat Exchanger 10 | Packless Industries | AES001672 |
| Control 34 | Ranco Inc. | 016-42 |
| Control 27 | Penn Corp. | P70AB-2 |
| Solenoid valves 12, 62, 55, 53 & 29 | Sporelan Valve Co. | E 35-130 |
| Safety Valve 56 | Superior | 3014-400 |
| Gauges on control panel | Ashcroft | Laboratory quality 1377-AS |
| Filter-Drier 63 | Sporlan Valve Co. | 384 cubic in. |

A unit constructed as disclosed above weighs about 325 lbs.

When the system illustrated is utilized in repair of the refrigerating system of an air conditioner, for example, fluid conduit 11 is connected to a refrigerant outlet in the refrigeration system, the power is turned on and valve 12 is opened. Control 27 at the inlet to the compressor is activated when it senses pressure in fluid conduit 31, and with the power turned on compressor 30 begins to function. Refrigerant from the refrigeration system is drawn into the reclaim system through conduit 11. Normally the refrigerant at this point will be a liquid, which has been illustrated in the drawings by double cross hatching inside the fluid conduit. At some point in fluid conduit 13 of heat exchanger 10 the refrigerant is converted to gaseous form by the heat transferred to it from conduit 15 carrying the output of compressor 30. The single cross hatching in fluid conduit 13 is illustrative of refrigerant in gaseous form. Throughout the drawing double cross-hatching indicates liquid and single cross-hatching gas or vapor. The refrigerant flows through fluid conduits 16 and 21 into oil separator 20. It is at this point relatively hot and is an expanding gas rising rapidly within the tank of oil separator 20. The upward flow of gas is abruptly interrupted by the baffle 23 causing oil to be separated and to drop to the bottom of the tank. The gaseous refrigerant passes around the outer (lower) edge of skirt 25 which is spaced from the interior wall of the surrounding tank by an amount providing a total open area which is approximately equal to the open area at the upper end of conduit 22. The gaseous refrigerant passes around skirt 25 into the upper end of fluid conduit 22, then through fluid conduit 26 into fluid conduit 31.

So long as there is sufficient pressure in fluid conduit 31 to indicate that the refrigeration system of the air conditioner has not been completely evacuated, compressor 30 will continue to run. Refrigerant from fluid conduit 31 passes into the compressor, is compressed and discharged through fluid conduit 32 and passes through the heat exchanger in fluid conduit 15 and then through fluid conduit 41 into condenser 40 through condenser inlet 42. The gaseous refrigerant entering the condenser is converted into a liquid at some point in the condenser such as 44.

Liquid refrigerant passes out of the condenser 40 into conduit 43 and through that conduit into the upper portion of chill tank 50. At this point valves 53 and 62 are closed and the compressor will continue to withdraw refrigerant from the refrigeration system of the air conditioner, and to cause liquid refrigerant to be discharged into chill tank 50 until the pressure at the inlet to compressor 30 drops to virtually zero PSIG indicating all of the refrigerant has been removed from the refrigeration system of the air conditioner. At this point control 27 will act to shut down compressor 30.

After waiting to see if pressure again will build up in conduit 31 and cause the compressor to start up again, the operator will close value 12 (refrigerant intake) and open valve 62 causing liquid refrigerant to leave the chill tank 50 through fluid conduit 52 and pass into the filter dryer 63 through fluid conduit 61. The liquid refrigerant then passes through expansion device 64, where it is converted into a gas and passes through coil 65 to cool the liquid refrigerant, illustrated in the drawing as filling approximately ¾ of chill tank 50 and having the coil 65 submerged in it. When expanding gas from coil 65 reaches the compressor inlet conduit 31 via fluid conduit 66, there will be sufficient pressure to actuate control 27, and the compressor will automatically start running again.

With valve 12 closed, the cold side of heat exchanger 10 and the entirety of oil separator 20 are shut down. With pressure in fluid conduit 31, the compressor continues to operate and the gaseous refrigerant which entered the compressor through conduits 66 and 31 is compressed and discharged from the compressor through fluid conduit 32 and thence through the heat exchanger 10 and condenser 40 back into the chill tank 50 and the cycle just described is repeated again and again until the temperature of the liquid refrigerant in chill tank 50 has been reduced to the desired level, normally about 38 to 45 degrees Fahrenheit.

The repeated passing of liquid refrigerant through filter dryer 63 removes substantially all acid and water from the liquid refrigerant. During this recycling, normally a certain amount of air will be separated from the refrigerant and collect in the upper portion of chill tank 50 causing the pressure there to rise. Air can be removed from the reclaim system by opening valve 55 so that the air escapes through conduit 54. This is normally done when the pressure within chill tank 50 reaches something in excess of 300 PSIG and is done by activating a switch, preferably a push button, on the control panel. In the event for some reason pressure should reach a level of about 400 PSIG, safety valve 56 will be actuated and gases in the system will be vented.

Before any liquid refrigerant is returned to the refrigeration system of the air conditioning unit, which is done by closing valve 62 and opening valve 53, any oil which has been collected in the bottom of oil separator 20, as schematically illustrated in the drawing, should be removed through outlet 28 by opening valve 29. The amount of oil removed should be measured so that an appropriate amount of oil can be resupplied to the refrigeration system.

The refrigerant reclaim system of this invention can be utilized to transfer refrigerant from one container to another. This is done by connecting the fluid conduit 11 to the container from which refrigerant is to be taken (the first container) and fluid conduit 52 to the receiving or second container. Upon opening valve 12 and supplying power to compressor 30, refrigerant will be removed from the container and passed through the heat exchanger 10, the oil remover 20, the compressor 30, the condenser 40, and into chill tank 50. Operation is continued in this mode until the pressure display on the control panel indicates the first container has been evacuated. As in other operations when all of the refrigerant has been removed from the first container, pressure in line 31 will drop to virtually zero PSIG, thus actuating control 27 and shutting off the compressor which will not begin to run again until there is pressure in line 31 from the gaseous refrigerant exiting from the cooling device 60. Valve 12 is then closed. Since it will facilitate discharging the refrigerant into the receiving container, it is desirable that valve 53 first be closed and valve 62 opened so that cooling device 60 will be operative. Operation in this mode is continued for a sufficient period to reduce the liquid refrigerant in chill tank 50 to the desired temperature. When the desired temperature is reached, valve 62 is closed, valve 53 opened, and liquid refrigerant will flow from the chill tank 50 into the receiving container by gravity, and any pressure from gases in the upper portion of chill tank 50.

What is claimed is:

1. A refrigerant recovery and purification system comprising:

a refrigerant compressor having an input and an output;

means including evaporator means and an oil separation chamber for connecting said compressor input to a refrigeration system from which refrigerant is to be recovered;

condenser means coupled to said compressor output in heat exchange relation to said evaporator means for transferring heat from refrigerant in said compressor output to refrigerant in said evaporator means;

refrigerant storage means;

means for feeding liquid refrigerant from said condenser means to said refrigerant storage means; and wherein said evaporator means and said condenser means are not located within the interior of said oil separation chamber.

2. The refrigerant recovery and purification system of claim 1 further comprising:

filter means for removing contaminants from refrigerant passing therethrough; and means for circulating refrigerant in a closed path from said refrigerant storage means through said filter means and back to said refrigerant storage means.

3. The refrigerant recovery and purification system of claim 2 wherein said circulating refrigerant means includes said compressor.

4. The refrigerant recovery and purification system of claim 2 wherein said filter means comprises means for removing water vapor from refrigerant passing therethrough.

5. The refrigerant recovery and purification system of claim 1 wherein said oil separation chamber is comprised of a cylinder, baffle means mounted in the upper portion of the interior of the cylinder such that there is a small space between the baffle means and the interior wall of the cylinder, means above the baffle having an opening permitting gaseous refrigerant to leave the cylinder, and means in the lower portion of the cylinder permitting entry of gaseous refrigerant into the cylinder.

6. A refrigerant recovery and purification system comprising:

a refrigerant compressor;

an oil separation chamber;

a heat exchange element comprised of a hot side and a cold side, located outside of said oil separation chamber;

a refrigerant storage cylinder;

means including said cold side of said heat exchange element and said oil separation chamber for connecting said compressor to a refrigeration system from which refrigerant is to be recovered; and means including said hot side of said heat exchange element for connecting said compressor to said refrigerant storage cylinder.

7. In an apparatus for reclaiming refrigerant, means for removing refrigerant from a container and separating oil from the refrigerant, comprising a heat exchanger having a hot side and a cold side, means connecting the cold side of the heat exchanger to the refrigerant container, means for connecting the hot side of the heat exchanger to a source of hot gaseous refrigerant, means for causing refrigerant from the container to flow through the cold side of the heat exchanger, means for passing heated gaseous refrigerant from the heat exchanger into the lower portion of an elongated vertically extending separator tank, baffle means in the upper portion of the separator tank for interrupting the flow of rising expanding hot gaseous refrigerant, the periphery of the baffle means providing a narrow opening between the baffle and the inner wall of the tank to permit escape of gaseous refrigerant around the baffle and a fluid conduit having an inlet above the baffle for removing gaseous refrigerant from the separator tank.

* * * * *